United States Patent [19]

Salo

[11] Patent Number: 4,715,185

[45] Date of Patent: Dec. 29, 1987

[54] METHOD AND MEANS FOR INCREASING ENERGY OUTPUT AND THERMAL EFFICIENCY OF AN ENERGY CYCLE SUCH AS THE RANKINE STEAM CYCLE

[76] Inventor: Eric A. Salo, 15898 Via Pinale, San Lorenzo, Calif. 94578

[21] Appl. No.: 916,009

[22] Filed: Oct. 3, 1986

[51] Int. Cl.[4] ..... F01K 17/00

[52] U.S. Cl. ..... 60/677; 417/64

[58] Field of Search ..... 60/653, 677, 678, 679; 417/64

[56] References Cited

U.S. PATENT DOCUMENTS 3,990,243 11/1976 Davoud ..... 60/679 X 4,249,384 2/1981 Harris ..... 60/653 X 4,576,008 3/1986 Silvestri, Jr. ..... 60/679 X

*Primary Examiner*—Stephen F. Husar

*Attorney, Agent, or Firm*—Frank A. Neal

[57] ABSTRACT

Multi-stage extraction steam is taken at varying pressures from a mixed pressure turbine and sequentially charged into closed path conveyor compartments to progressively increase the pressure of steam within the compartments. The highest pressure stage of extraction steam is then used to displace the steam from the compartments through a reheater and back to an injection station at the turbine, thereby repressurizing and reheating effluent turbine steam and returning it to the turbine for reuse without incurring the heat losses of condensation.

4 Claims, 10 Drawing Figures

THERMAL ENERGY
CYCLE COMPARISON

| CYCLE | PERFORMANCE | |
|---|---|---|
| STRAIGHT CONDENSING | 27% EFFICIENCY | 12700 BTU/KW-HR |
| REGENERATIVE (RANKINE) | 34% EFFICIENCY | 10100 BTU/KW-HR |
| REHEAT / REPRESSURE | 74% EFFICIENCY | 4600 BTU/KW-HR |

FIG. 9

COMBINED RANKINE AND
REPRESSOR / REHEATER
CYCLES

| REPR. / REH. | RANKINE | EFFICIENCY | HEAT RATE |
|---|---|---|---|
| 20 % | 80% | 39 | 8200 |
| 50 % | 50 % | 54 | 6000 |
| 80 % | 20 % | 65 | 5000 |
| — | 100 % | 34 | 9400 PRACTICAL OPTIMUM PRESENTLY |

FIG. 10

METHOD AND MEANS FOR INCREASING ENERGY OUTPUT AND THERMAL EFFICIENCY OF AN ENERGY CYCLE SUCH AS THE RANKINE STEAM CYCLE

SUMMARY OF THE INVENTION

Energy cycles of the type which utilize steam turbines to drive electrical generators are conventionally low in energy output and thermal efficiency.

The straight condensing cycle type in which all of the effluent steam from the turbine is put through waste heat condensation to provide boiler feed water has a heat rate of 12,700 Btu/Kw-Hr and a 27% efficiency.

When the Rankine steam cycle is employed, a major part of the effluent steam from the turbine is used to pre-heat feed water for the steam generator, thereby reducing waste heat and providing a heat rate of about 10,100 Btu/Kw-Hr and a thermal efficiency of about 34%. This operation still entails a heat loss due to change of state of 970–1,000 Btu/lb of steam.

According to the subject invention, up to half or more of the extraction steam from the turbine is passed through a Repressor/Reheater cycle, or a repressurization and reheating cycle, and back to the turbine for conversion to mechanical energy. The heat rate of the Repressor/Reheater cycle in conjunction with the steam turbine is about 4,500 Btu/Kw-Hr and the thermal efficiency is about 74%.

The essential object of the invention is to combine the Repressor/Reheater cycle with a regenerative cycle, such as the Rankine cycle.

When the steam flows from the turbine are regulated to provide a 20% flow to the Repressor/Reheater cycle and an 80% flow to the Rankine cycle, the heat rate and efficiency figures are about 8,200 Btu/Kw-Hr and 39%. With a 50% steam flow to the Repressor/Reheater phase and a 50% flow to the Rankine phase, the heat rate and efficiency figures are about 6,000 Btu/Kw-hr and 54%. With an 80% steam flow to the Repressor/-Reheater phase and a 20% steam flow to the Rankine phase, the heat rate and efficiency values are about 5,000 Btu/Kw-hr and 65%.

The repressor is adapted to convey compartmented charges of partially expanded steam from the turbine into and through stages of supply of higher pressure steam from the turbine. Steam in the highest pressure stage of the repressor is displaced through a fired reheater in which the enthalpy of the steam is increased substantially to permit its readmission into the reentry steam turbine to generate additional energy at higher output.

The repressor is constructed along the lines of the toroidal pump shown and described in my U.S. Pat. No. 3,930,757, issued Jan. 6, 1976, although it is driven by an electro-magnetic drive energized by regulated frequency electric polyphase power as shown and described in my U.S. Pat. No. 4,593,215, issued Jun. 3, 1986.

DESCRIPTION OF THE DRAWINGS

FIG. 9 shows a data table relating to thermal energy cycle comparison.

FIG. 10 shows a data table relating to combined Rankine and Repressor/Reheater cycles.

PRIOR ART

Figure 1:
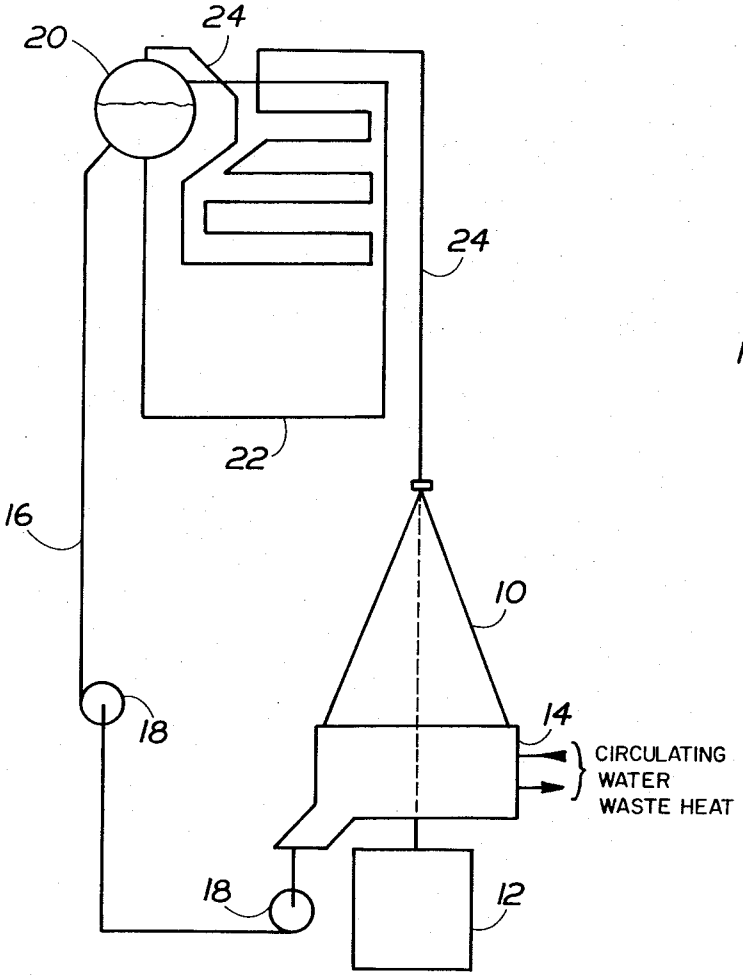
FIG. 1 is a semi-schematic view of the straight condensing cycle system of the prior art.

The straight condensing cycle of FIG. 1 comprises steam turbine 10, electrical generator 12 in driven relation to turbine 10, condensor 14 to condense the effluent steam from turbine 10 to water, conduit 16 with pumps 18 to feed the resulting water to boiler 20, heater 22 containing fuel burners, not shown, and steam line 24 extending from the boiler 20 through the heater 22 to the turbine 10.

As indicated in the table of FIG. 9, the straight condensing cycle has a heat rate of 12,700 Btu/Kw-hr and a 27% efficiency.

Figure 2:
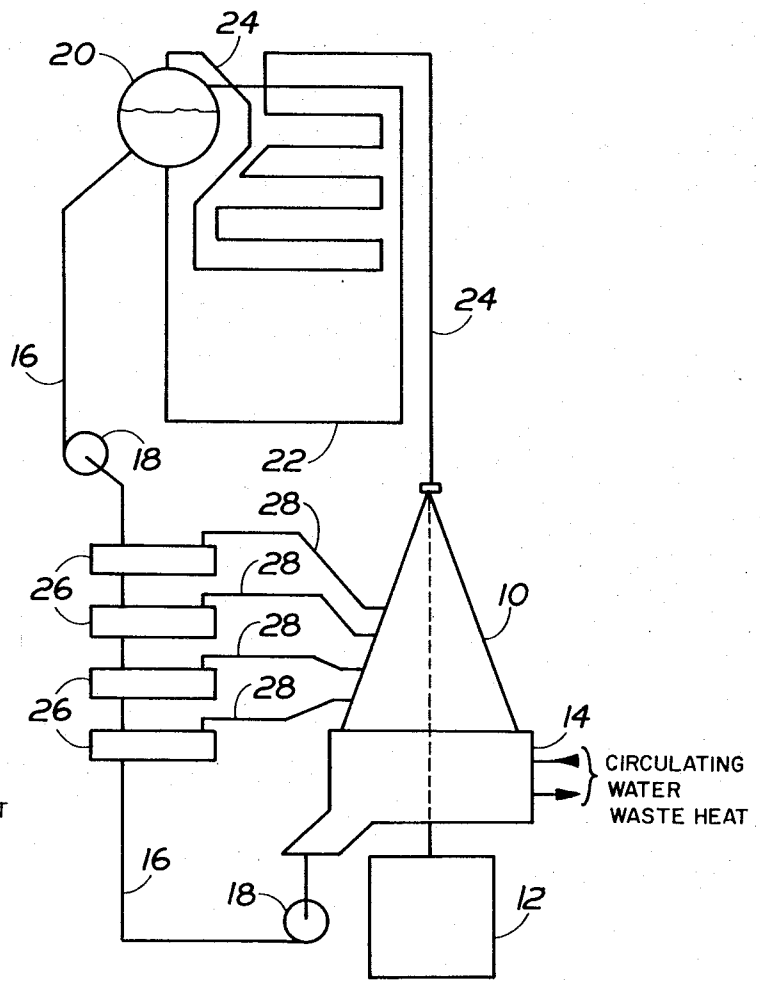
FIG. 2 is a semi-schematic view of the regenerative Rankine cycle system of the prior art.

In FIG. 2, which depicts the regenerative or Rankine cycle, elements corresponding to those of FIG. 1 have similar reference numbers. This cycle includes a plurality of heat exchangers 26 in the conduit 16 and a plurality of effluent steam conduits 28 interconnecting the turbine 10 and the exchangers 26 and adapted to deliver effluent steam at varying temperature-pressure values to the exchangers to pre-heat the returned feed water to the boiler. Only part of the effluent steam is condensed in condensor 14, the remainder being used to pre-heat the feed water.

As indicated in the table of FIG. 9, the Rankine cycle of FIG. 2 has a heat rate of 10,100 Btu/Kw-hr and a 34% efficiency.

DESCRIPTION OF THE INVENTION

Figure 3:
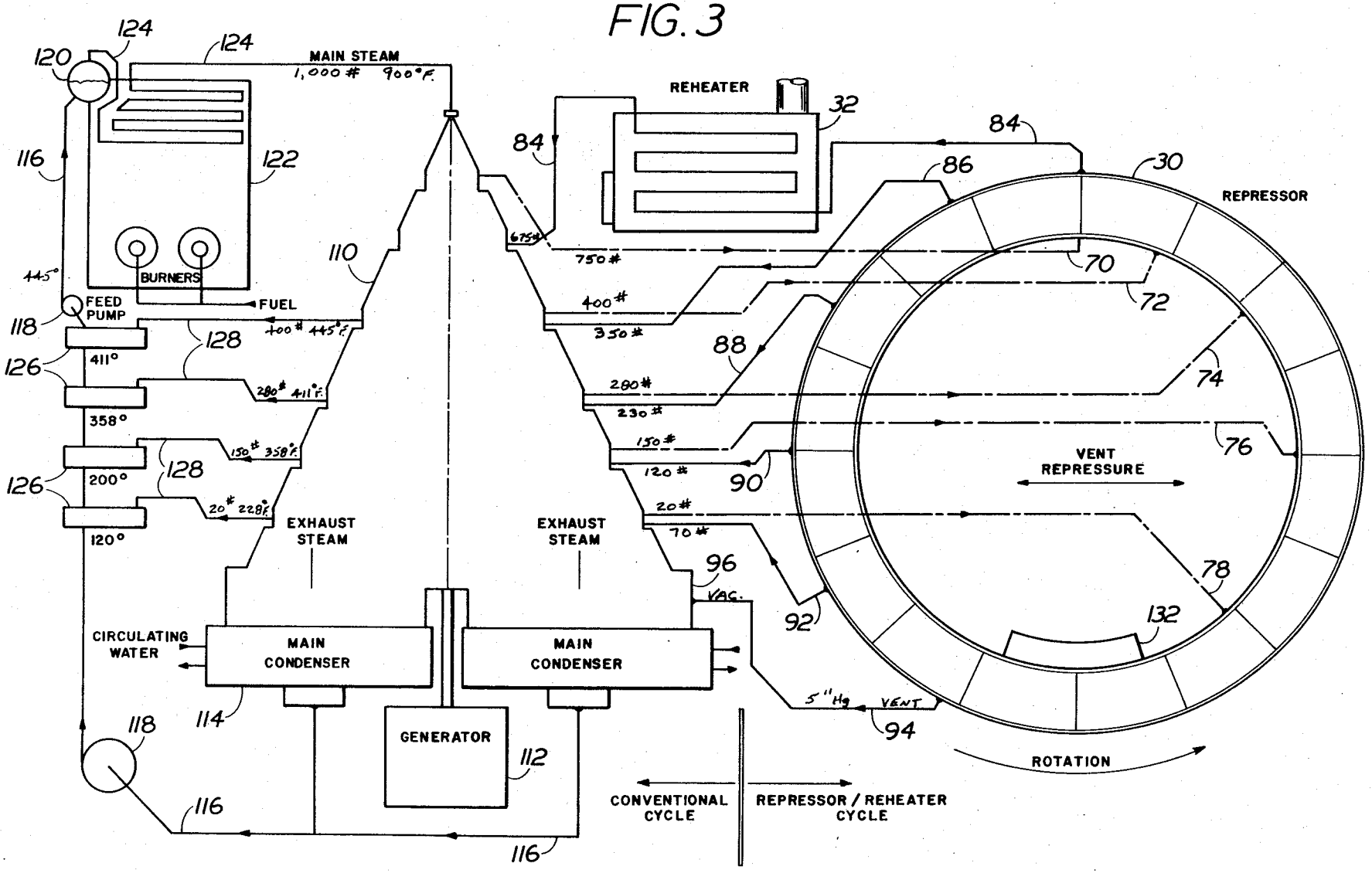
FIG. 3 is a semi-schematic view of a preferred system of the invention.

FIG. 3 shows a preferred embodiment of the apparatus of the invention, a combination of the conventional cycle of FIG. 2 and a Repressor/Reheater cycle indicated generally by 30 and 32.

As indicated in the tables of FIGS. 9–10, the Repressor/Reheater cycle of FIG. 3 has a heat rate of 4,600 Btu/Kw-hr and an efficiency of 74%. When this cycle is combined with the Rankine cycle of FIG. 2, the overall heat rate and efficiency values are increased substantially. When 20% of the effluent steam goes to the Repressor/Reheater part of the equipment and 80% to the Rankine part, the overall heat rate is 8,200 Btu/Kw-hr and the overall efficiency is 39%; when the effluent steam is apportioned 50%–50%, the heat rate is 6,000 Btu/Kw-hr and the efficiency is 54%; and when the effluent steam is apportioned 80% to the Repressor/-Reheater part and 20% to the Rankine part, the heat rate is 5,000 Btu/Kw-hr and the efficiency is 65%.

Figure 4:
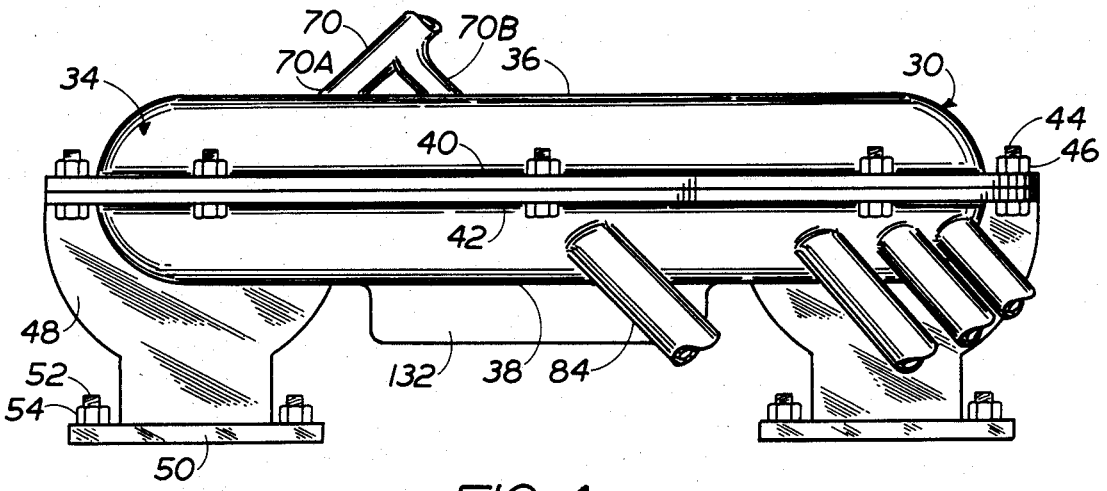
FIG. 4 is a view in edge elevation of the repressor unit.
Figure 5:
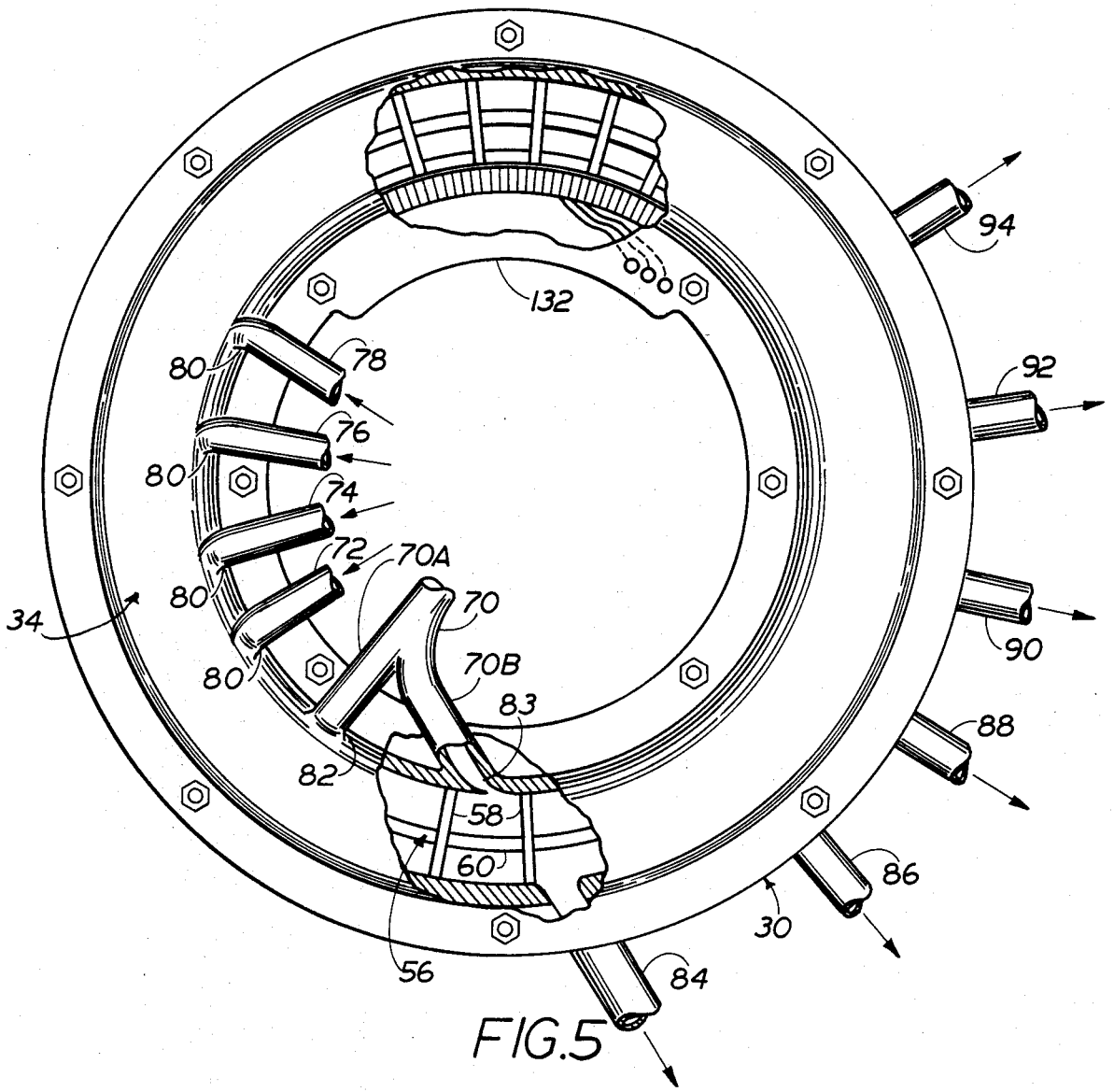
FIG. 5 is a plan view of the repressor with breakaway portions to illustrate mechanical and electrical construction.

The repressor 30 comprises (See FIGS. 4–5) a toroidal casing 34, preferably mounted horizontally. The casing has upper and lower portions 36, 38 provided with matching flanges 40 and 42. The flanges are secured together to a leak-proof tightness by studs 44 and nuts 46. Some of the studs 44 are threadably driven into threaded sections of metal support saddles 48. The saddles are integral with base plates 50 which are firmly secured as by studs 52 and nuts 54 to suitable concrete footings, not shown. So mounted, the casing 34 and its internal conveyor ring 56 are anchored against stresses from connecting pipes and to suppress vibration of casing 34 and ring 56.

Figure 6:
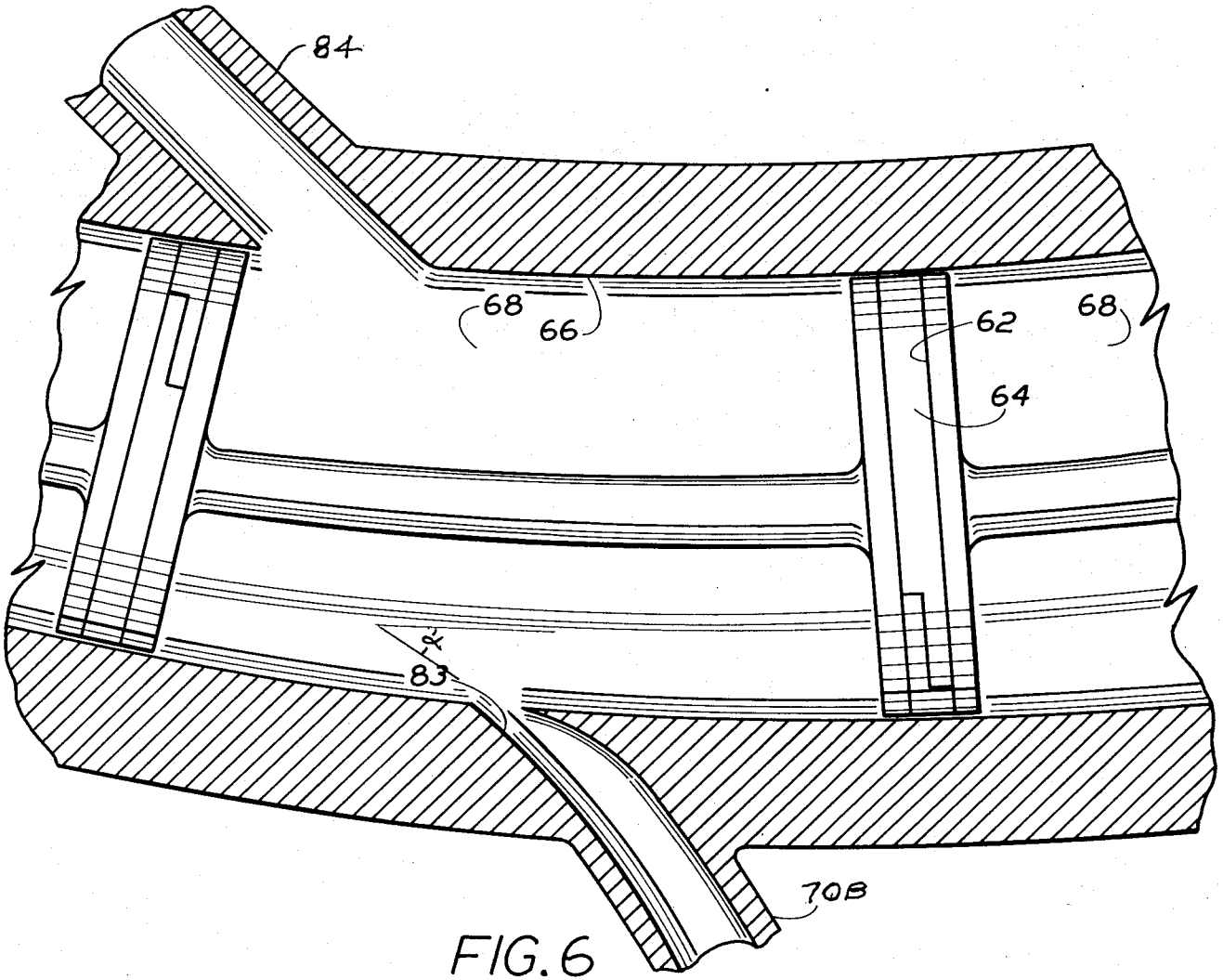
FIG. 6 is an enlarged view of the repressor portion shown in the right-hand breakaway part of FIG. 5.
Figure 7:
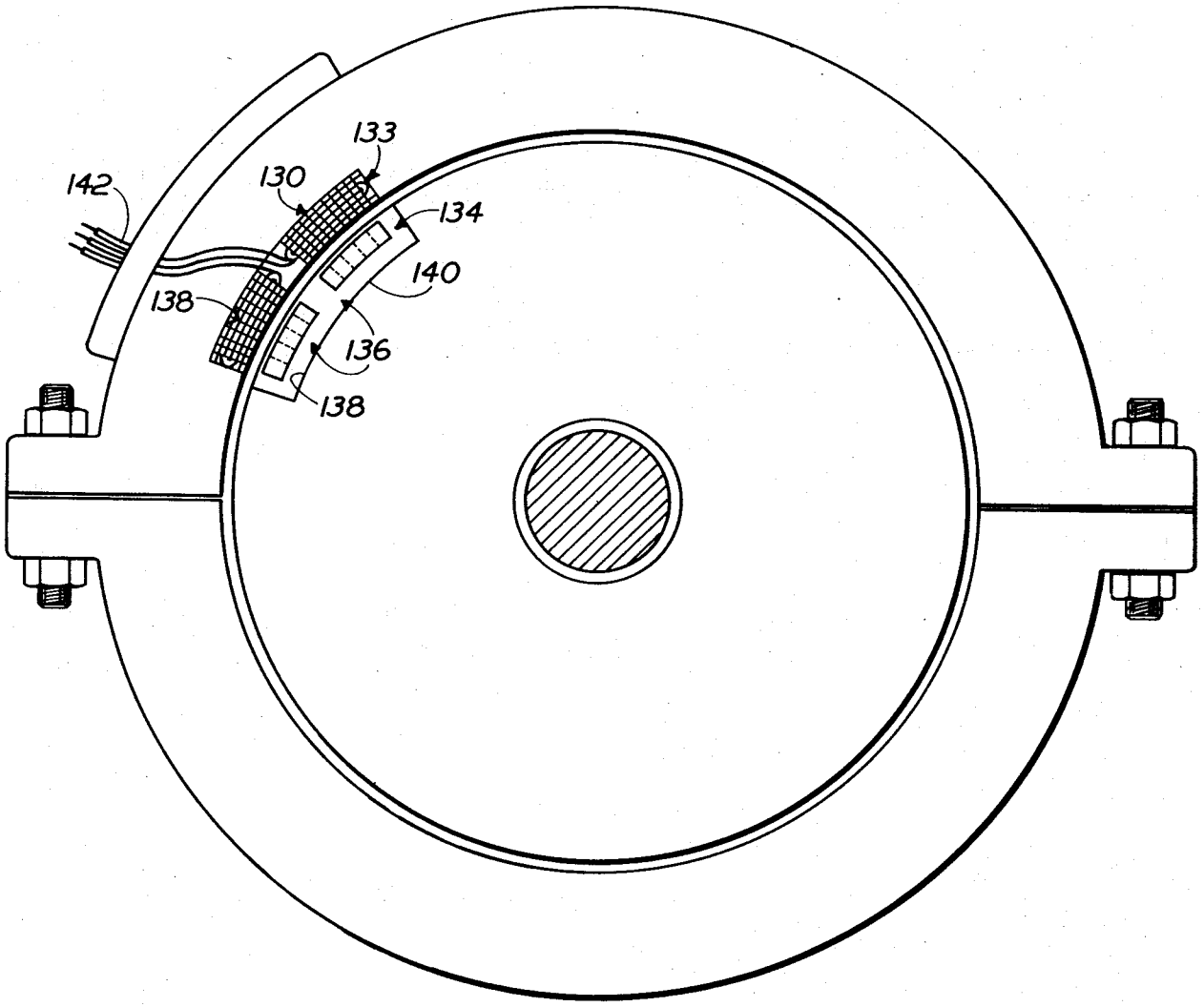
FIG. 7 is an enlarged transverse view of the torus or ring of the repressor, as along lines 7—7 of FIG. 5.

The internal conveyor ring 56 is comprised of a full circular complement of equally spaced apart seal discs 58 connected at their centers by arcuate connector/-spacer rods 60. Discs 58 are machined to provide rectangular grooves 62 (see FIG. 6) into which piston rings 64 are fitted. Rings 64 have sufficient lateral clearance in grooves 62 to enable the rings to self-expand diametrically to fit against casing bore surface 66 for continuously maintaining containment of steam and the pressure thereof within the intra-disc compartments 68.

Two sets of steam conduits interconnect turbine 110 and repressor 30. One set comprises conduits 70, 72, 74, 76, 78 adapted to convey extraction steam from turbine 110 into pre-selected intra-disc compartments 68.

Conduits 72, 74, 76, 78 are connected to the lower casing portion 38 through ports 80 which are flush with the casing bore 66. Conduit 70 connects to the upper casing portion 36 through conduit 70A terminating in port 82 and conduit 70B terminating in port 83. Conduit 70A serves to convey the highest pressure steam to chambers 68 for their final pressurization and conduit 70B serves to convey the highest pressure steam to the chambers 68 at a later point in their rotative positional sequence to force the high pressure steam out of the chambers 68 and into conduit 84 to the reheater 32.

Ports 80 and 83 are angled forwardly in the direction of rotation of ring 56 so that little or no energy is required to drive the ring other than that furnished by the steam passing through these ports. Port 83 is provided with a slightly constricted jet nozzle outlet having an angle alpha between the axis of said outlet and the axis of casing bore 66. The angle alpha may have a value of from about 30° to about 45° and is shown as having a value of 38°.

The second set of steam conduits interconnecting turbine 110 and repressor 30 comprises conduit 84, which extends between repressor 30 and reheater 32 and between reheater 32 and turbine 110, and conduits 86, 88, 90, 92 extending between the repressor and the turbine. The conduits 84, 86, 88, 90, 92 convey injection steam to the turbine. Conduit 94 vents the steam-depleted chambers 68 or the repressor to the exhaust steam manifold 96 of the turbine. Conduits 84–94 connect to the lower casing portion. Conduits 70B and 84 are in general alignment with each other and are generally similarly angled relative to the path of rotation of ring 156.

The steam pressures within the mixed-pressure turbine at the outlet ends of conduits 84, 86, 88, 90, 92 are substantially lower than the steam pressures in the repressor at the inlet ends of said conduits, thereby producing the required steam flow from repressor to turbine. The steam pressures within the repressor at the outlet ends of conduits 70, 72, 74, 76, 78 are substantially lower than the steam pressures in the turbine at the inlet ends of said conduits, thereby producing the required steam flow from turbine to repressor.

Repressor 30 does not act as a pump. Within each transport ring compartment the steam pressures on the leading and trailing discs 58 are the same. Repressor 30 acts as a conveyor to move compartments of progressively higher steam pressure between the inlets of conduits 78 and 70 and to move compartments of progressively lower steam pressure between the inlets of conduits 84 and 92.

In the progressive nature of charging the repressor with live extraction steam from the turbine, the extraction steam has already delivered kinetic energy to the turbine blades. It will now be repressurized through the repressor, reheated through the reheater, and delivered to the turbine to impart considerably more kinetic energy thereto without going through the thermodynamically wasteful change of state to water in a condensor, as occurs with the turbine exhaust steam in condensor 114.

By eliminating a substantial portion of the waste energy of the FIG. 2 steam system chargeable to the latent heat losses of the steam, the combined steam of the invention embodiment of FIG. 3 is rendered substantially more energy-efficient inasmuch as the efficiency of the Repressor/Reheater steam cycle approaches 80%.

The essential purpose and function of the Repressor/-Reheater sub-system is therefore seen to be the conveying of compartmented charges of partially expanded steam into and through stages of supply of higher pressure steam to a fired reheater where the enthalpy of the steam is increased substantially to permit its readmission into a reentry steam turbine to generate additional energy at higher output.

For operation of the repressor at low speed and for rotational speed control of the rotor or ring 156 thereof, an electro-magnetic drive mechanism is provided. The purposes, function, constructional arrangement, and manner of operation are described in full detail in my U.S. Pat. No. 4,593,215, issued Jun. 3, 1986.

The electro-motive drive mechanism is essentially a pair of side-by-side conventional polyphase induction motors. The armature windings 130 are installed in an arcuate recessed housing portion 132 of the lower portion 38 of the repressor casing and firmly fastened in position. In the peripheral sense, the windings 130 and their magnetic cores 133 extend only as a partial semicircle. The electro-magnetic rotor 134 is fabricated as a side-by-side pair of rings 136 inset into the repressor rotor or ring 156 and firmly attached thereto in registry with the stationary armature electro-magnetic circuitry comprising windings 130 and magnetic cores 133. Interjacent recesses 138 in the armature housing 132 and repressor rotor 156 are filled with high temperature particulate iron/epoxy platic 140 which laterally encloses and anchors windings 130, cores 133 and rings 136 in place. Polyphase electric current is led into the armature section by electrically insulated leads 142.

Figure 8:
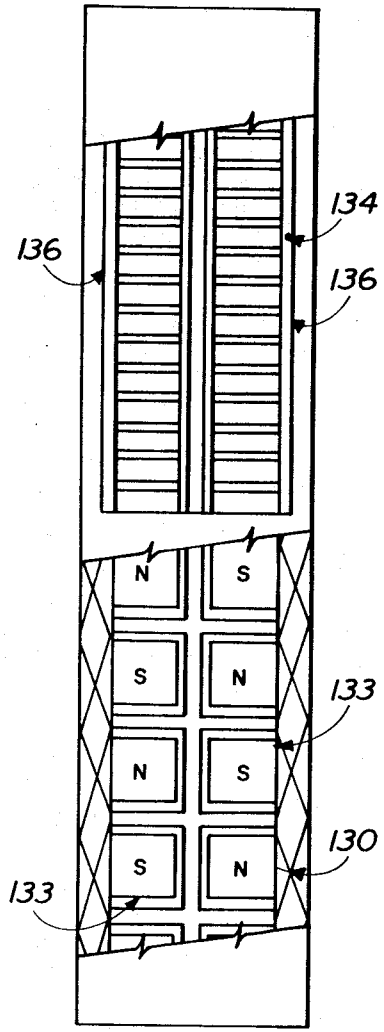
FIG. 8 is a semi-schematic view showing in developed relation stator and rotor winding, pole and core elements.

As shown in FIG. 8, and in more detail in U.S. Pat. No. 4,593,215, the disposition of the armature windings 130 provides for opposed magnetic polarities to provide opposed induced rotor currents which serve to oppose the setting up in the discs 58 of undesirable stray heating currents.

FIG. 3 sets forth exemplary operating temperature and/or pressure conditions for the steam entering and leaving turbine 110.

In the conventional or Rankine cycle portion of FIG. 3 elements corresponding to those shown in FIGS. 1–2 are identified by corresponding reference numerals plus 100.

Main steam at 1,000# or p.s.i. and 900° F. is sent to turbine 110 through line 124. Exhaust steam from the turbine is condensed in condensor 114. The condensate passes into line 116, is pumped through heat exchangers 126 where it is heated to 445° F., and is then pumped into boiler 120. Steam from the boiler passes through line 124 and superheater 122 and to the turbine.

Extraction steam from the turbine passes through lines 128 to the heat exchangers 126 at 400#–445° F., 280#–411° F., 150#–358° F., and 20#–228° F., as indicated in FIG. 3.

Extraction steam at 750# for line or conduit 70, at 400# for line 72, at 280# for line 74, at 150# for line 76, and at 20# for line 78, is sent to the repressor 30 from turbine 110.

Injection steam at 675# for line 84, at 350# for line 86, at 230# for line 88, at 120# for line 90, and at 70# for line 92, is sent to the turbine from repressor 30.

Since the 750# steam of line 70 displaces the steam from the ring compartments 68 into line 84, the initial pressure in line 84 is also 750#. As line 84 passes through superheater 32 and reaches turbine 110, the steam pressure therein has dropped to 675# due to friction losses.

What is claimed is:

1. In the combination of an electrical generator and a steam drive therefor, the improvement comprising first means for repressurizing partially expanded steam from the turbine, second means for reheating the repressurized steam, and third means for feeding the repressurized reheated steam into the turbine into driving relation therewith under higher pressure and temperature conditions than those for said partially expanded steam, said first means comprising a continuous closed-path housing, a conveyor rotor therein having spaced interconnected discs defining with the housing steamconveying compartments, a plurality of conduits interconnecting different steam extraction stations at the turbine with different steam injection stations at the housing, whereby said compartments may receive steam under progressively higher pressure conditions, a conduit interconnecting the compartment under highest steam pressure with said second means while higher pressure extraction steam is being introduced into said compartment, whereby pressurized steam in said compartment is displaced into said second means and therethrough and through said through means to a high pressure injection station at said turbine, and one or more conduits adapted to thereafter interconnect said compartment with one or more other lower pressure injection stations at said turbine.

2. The improvement of claim 1, wherein the conduits to said housing are provided with outlet nozzles adapted to drive said conveyor rotor with steam delivered therethrough to said housing.

3. The improvement of claim 2, wherein said rotor is further provided with a drive comprising a polyphase induction motor carried by the housing and rotor, said motor having armature winding and core portions carried by the housing and including side-by-side poles of opposite polarity to minimize stray current-induced heating of housing and rotor.

4. A method for decreasing the heat rate and increasing the efficiency of a regenerative steam cycle-driven turbine and generator system comprising removing partially expanded steam from said turbine at a plurality of extraction stations of varying temperature and pressure values intermediate those of main steam to said turbine and those of steam which has been passed through said turbine, receiving and conveying steam, from one of said extraction stations of lesser steam temperature and pressure values, between input and discharge stations, repressurizing the steam being so conveyed by injecting into it steam from another of said extraction stations of greater steam temperature and pressure values, receiving the repressurized steam from said discharge station and reheating it, and conveying the repressurized reheated steam to said turbine and injecting it therein to mix with working steam therein.

* * * * *